US009356380B1

(12) United States Patent
Ma

(10) Patent No.: US 9,356,380 B1
(45) Date of Patent: May 31, 2016

(54) POWER ADAPTOR

(71) Applicant: Stuff Electronics (Dongguan) Limited, Dongguan (CN)

(72) Inventor: Ka Yeung Henry Ma, Dongguan (CN)

(73) Assignee: STUFF ELECTRONICS (DONGGUAN) LIMITED, Dongguan, Guangdong (CN)

( * ) Notice: Subject to any disclaimer, the term of this patent is extended or adjusted under 35 U.S.C. 154(b) by 0 days.

(21) Appl. No.: 14/830,746

(22) Filed: Aug. 20, 2015

(51) Int. Cl.
*H01R 13/60* (2006.01)
*H01R 13/44* (2006.01)
*H01R 27/02* (2006.01)
*H01R 13/717* (2006.01)

(52) U.S. Cl.
CPC ..... *H01R 13/44* (2013.01); *H01R 13/7175* (2013.01); *H01R 27/02* (2013.01)

(58) Field of Classification Search
CPC ..... H01R 27/00; H01R 35/04
USPC ..... 439/131, 172, 171, 173
See application file for complete search history.

(56) References Cited

U.S. PATENT DOCUMENTS 9,024,581 B2 * 5/2015 McGinley ..... H01R 31/065 320/111
9,236,699 B2 * 1/2016 Lai ..... H01R 31/065
2014/0308853 A1 * 10/2014 Colahan ..... H01R 13/6675 439/628
2016/0056600 A1 * 2/2016 Liao ..... H01R 35/04 439/131

* cited by examiner

*Primary Examiner* — Phuongchi T Nguyen
(74) *Attorney, Agent, or Firm* — Leong C. Lei

(57) ABSTRACT

The present invention provides a power adaptor with a retractable plug. The power adaptor contains a main member, a retractable plug, and power sockets. The plug contains an insulating plug body and three pins. The plug body has a rotary knob member on each of two opposing circumferential sides of the plug body. The main member has an indentation within which the plug is configured. The indentation has two opposing knob sockets on the side wall. The plug can be retracted and housed in the indentation, and the pins have their terminal sections away from connection plates of the main member. When the plug is pulled and erected from the main member, the pins have their terminal sections contacting the connection plates of the main member.

10 Claims, 14 Drawing Sheets

POWER ADAPTOR

BACKGROUND OF THE INVENTION (a) Technical Field of the Invention

The present invention is generally related to power adaptors, and more particular to power adaptors with retractable plug.

(b) Description of the Prior Art

Power adaptors are common accessories for connecting power sources and electrical appliances. A conventional power adaptor usually contains a main member, a plug, and power sockets. The plug is usually fixedly configured on the main member. The bulging plug makes the power adaptor inconvenient to carry and store.

Therefore there are power adaptors whose plug is retractable into the main member so as to achieve enhanced convenience. However, these power adaptors still suffer the following shortcomings Firstly, the power adaptor are structured complicatedly and difficult to manufacture. Secondly, the repeated retractions and erections of the plug often leads to inferior electrical connection, causing unreliable operation and reduced life span. Thirdly, the plug's retraction mechanism is ill-designed, causing imprecise positioning of the plug at its retracted and erected states, and therefore unreliable operation.

SUMMARY OF THE INVENTION

Therefore the present invention provides a novel power adaptor having a retractable plug where the plug can be retracted into the power adaptor for enhanced convenience. The power adaptor achieves reliable positioning for the retractable plug, simplified structure, improved performance and life span, and easier to manufacture.

The power adaptor contains a main member, a plug on the main member, and power sockets.

The main member has an indentation along a circumferential side where a number of connection plates are configured on a bottom side of the indentation. Two knob sockets are configured on two opposing side walls of the indentation. Each knob socket has at least a second positioning element along the knob socket's circumferential side wall.

The plug configured in the indentation and the plug contains an insulating plug body, two knob member, and a number of pins for electrically connecting the connection plates, respectively. Each pin contains a prong section exposed outside the plug body and a terminal section inside the plug body. A circular knob member is configured on each of two opposing circumferential sides of the plug body. Each knob member is received by a corresponding knob socket and configured with at least a first positioning element on the knob member's circumference for engaging a corresponding second positioning element.

The plug can be retracted and housed in the indentation, and the pins have their terminal sections away from the connection plates of the main member. The terminal sections and the connection plates are not electrically contacting each other. When the plug is pulled and erected from the main member, the pins have their terminal sections contacting the connection plates of the main member.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
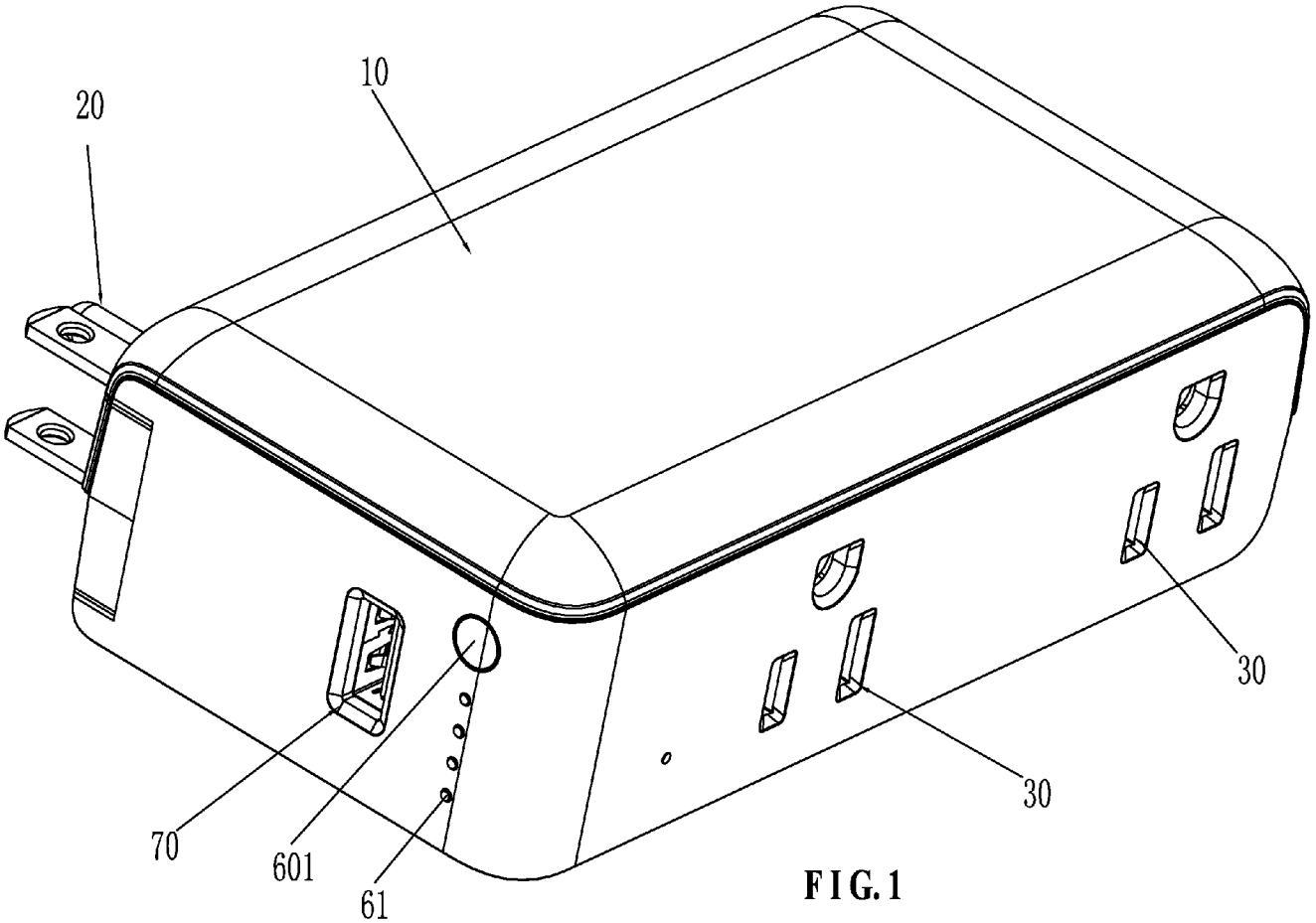
FIG. 1 is a perspective diagram showing a power adaptor according to an embodiment of the present invention.
Figure 2:
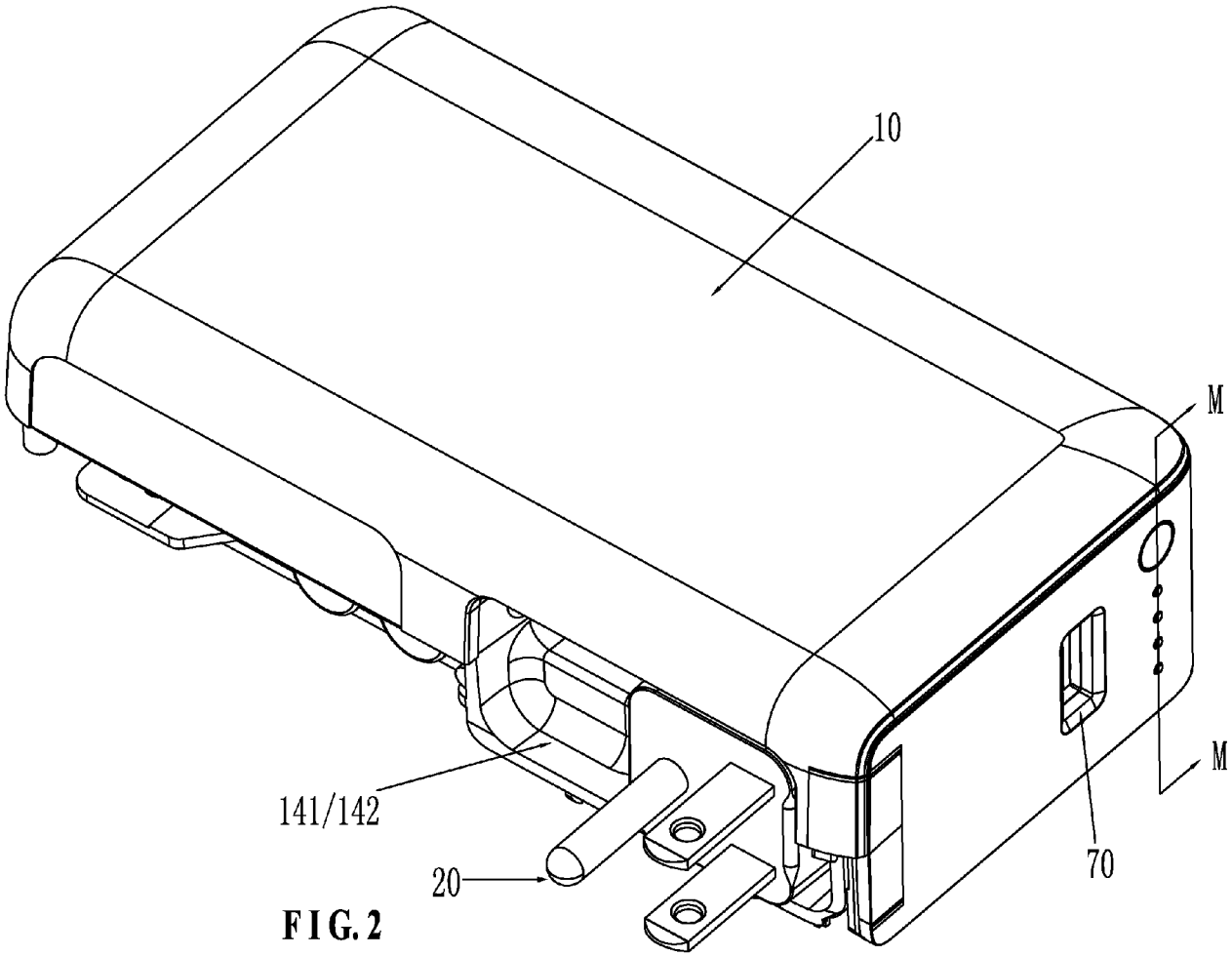
FIG. 2 is a perspective diagram showing the power adaptor of FIG. 1 with its plug erected but without a bottom casing.
Figure 3:
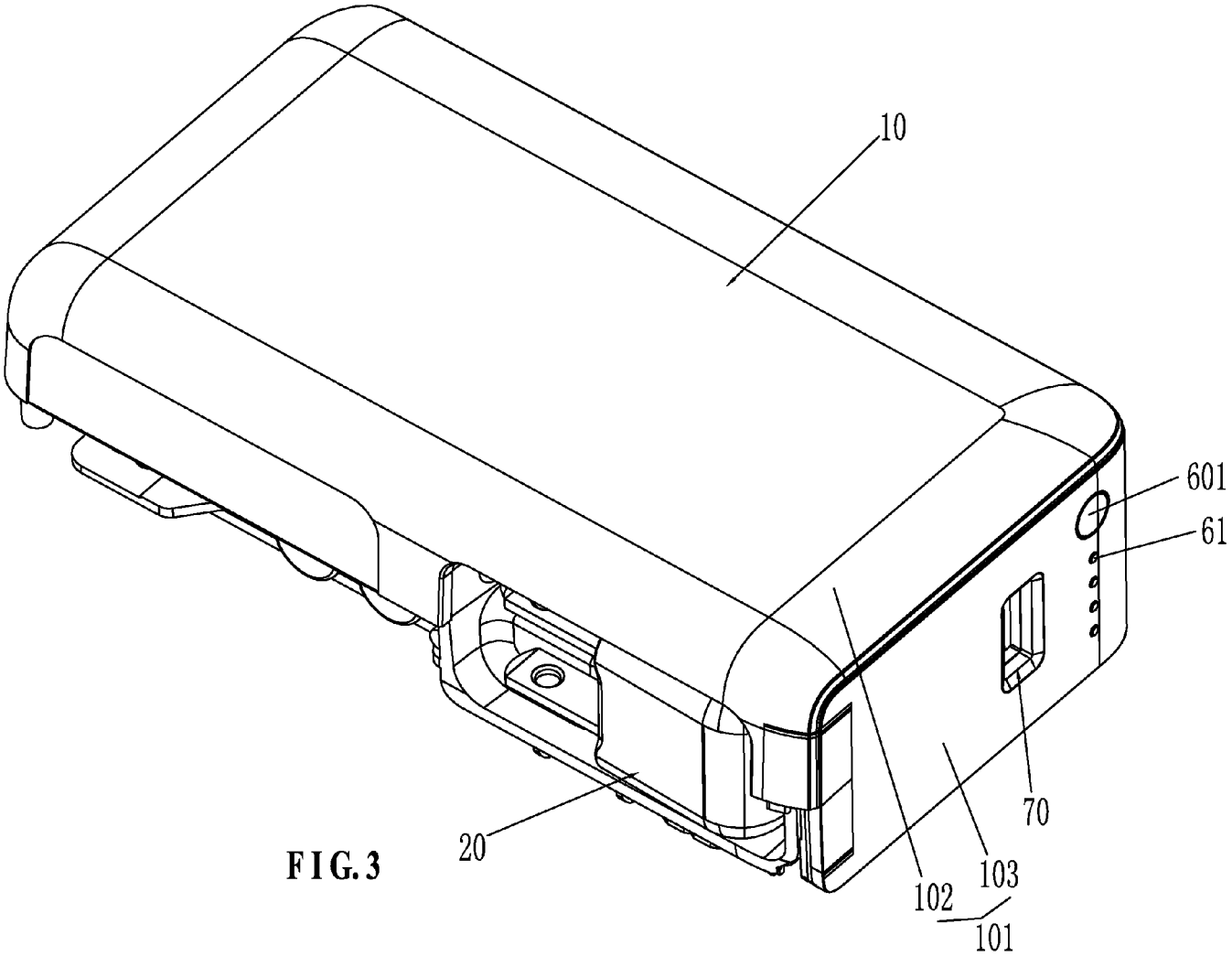
FIG. 3 is a perspective diagram showing the power adaptor of FIG. 1 with its plug retracted but without a bottom casing.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 14, a power adaptor according to an embodiment of the present invention contains a main member 10, a retractable plug 20 configured along a circumferential side of the main member 10, and power sockets 30.

The plug 20 contains an insulating plug body 24 and three pins: a positive pin 21, a negative pin 22, and a ground pin 23. Each of the pins 21, 22, and 23 contains a prong section 201 exposed outside the plug body 24 and a terminal section 203 housed inside the plug body 24. On each of two opposing circumferential sides of the plug body 24, a rotary knob member 25 is configured with first positioning elements 251.

The knob members 25 are of a circular shape, and the first positioning elements 251 are on the circumference.

Along the circumferential side of the main member 10 where the plug 20 is configured, an indentation is provided and the plug 20 is configured in the indentation. On a bottom side of the indentation, there are a positive connection plate 11, a negative connection plate 12, and a ground connection plate 13 for electrically connecting the positive, negative, and ground pins 21, 22, and 23. On two opposing side walls of the indentation, there are knob sockets 15 for receiving the knob members 25, and therefore are of a compatible circular shape. Alternatively, it is possible that the knob members are on the indentation's side walls whereas the knob sockets are on the plug body. Along the circumferential walls of the knob sockets 15, there are second positioning elements 151 for engaging the first positioning elements 251.

When the plug 20 is retracted into the indentation, the terminal sections 203 of the pins 21, 22, and 23 are away from the connection plates 11, 12, and 13, respectively, and there is no electrical contact therebetween. When the plug 20 is pulled out of the indentation, and the pins 21, 22, and 23 are perpendicular to the main member 10, the terminal sections 203 of the pins 21, 22, and 23 electrically contact the connection plates 11, 12, and 13, respectively.

Figure 5:
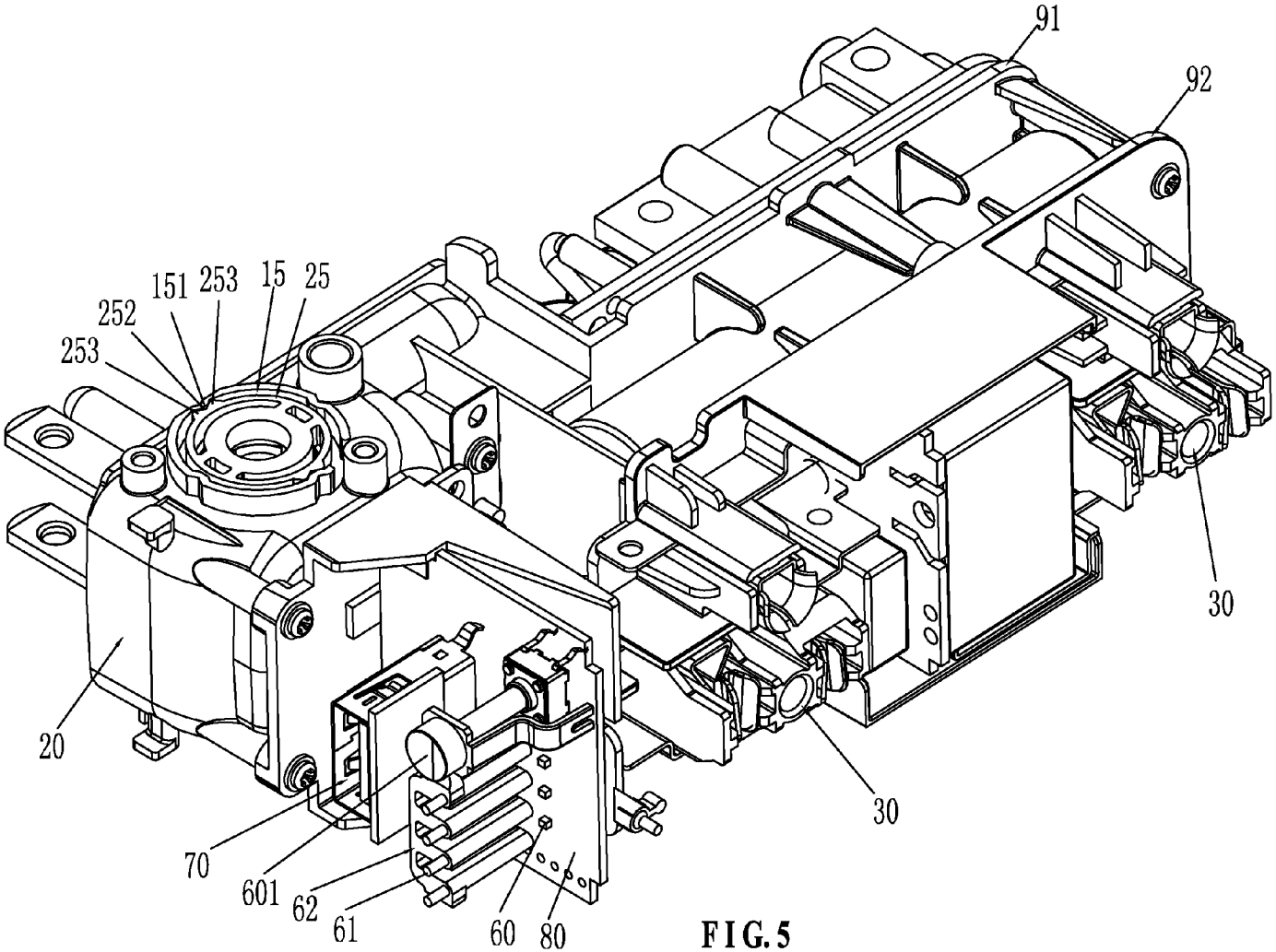
FIG. 5 is a perspective enlarged diagram showing a component marked as "A" in FIG. 4.
Figure 7:
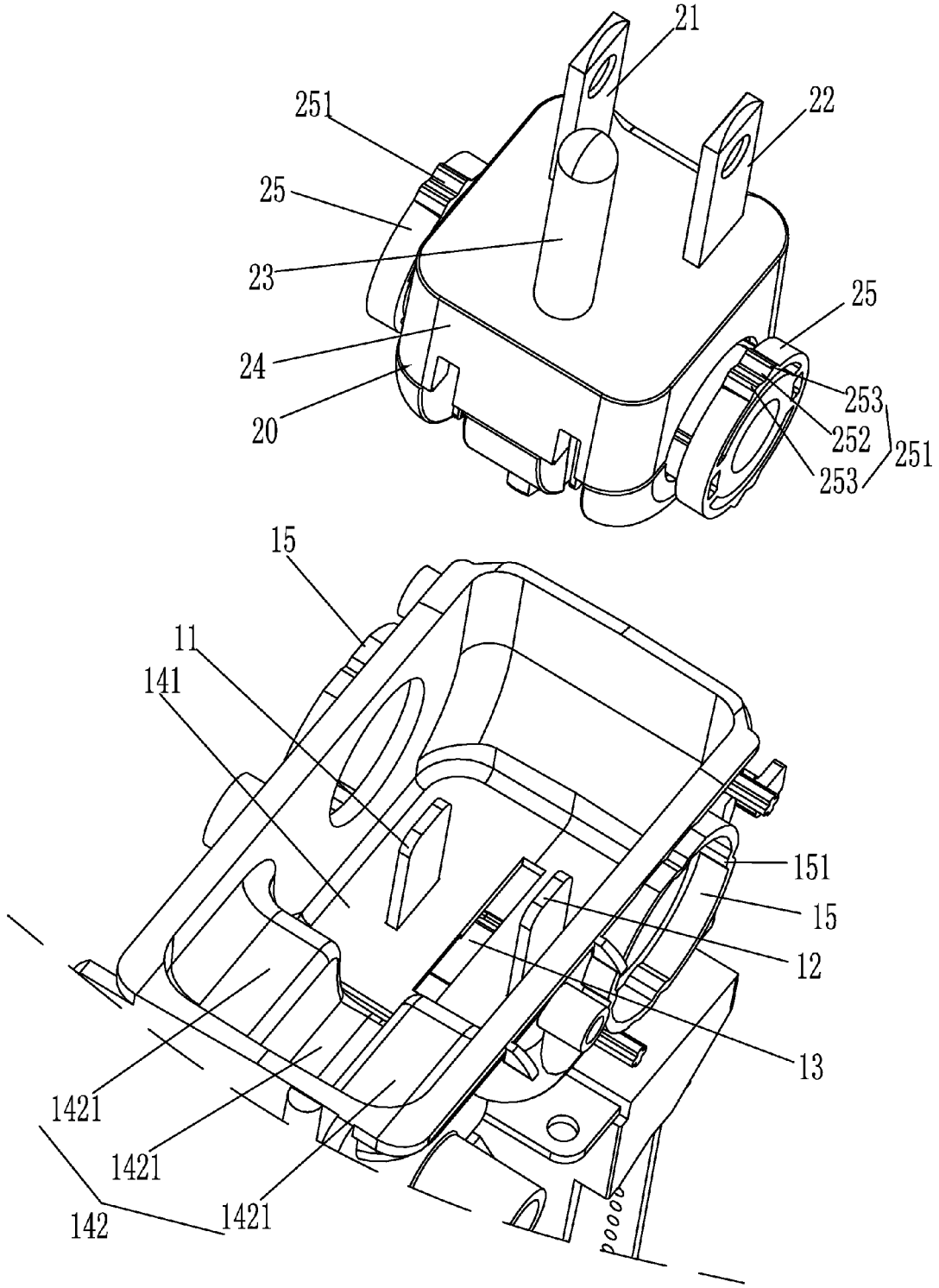
FIG. 7 is a perspective break-down diagram showing a plug and an indentation housing the plug of the component of FIG. 5.
Figure 8:
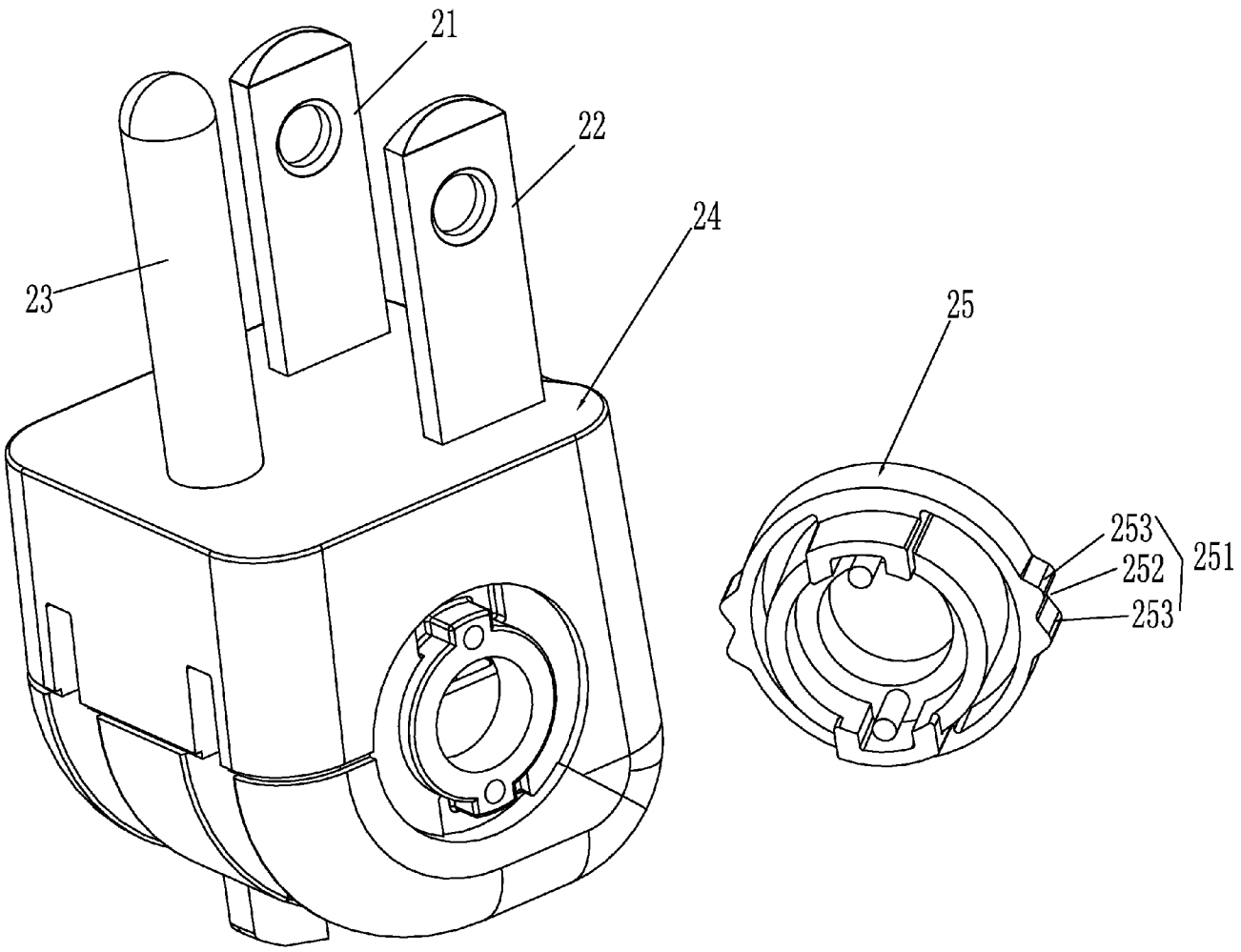
FIG. 8 is a perspective break-down diagram showing a plug of the power adaptor of FIG. 1.

More specifically, as shown in FIGS. 5, 7, and 8, the knob member 25 and the plug body 24 are separate items but assembled together. Each knob member 25 is of a circular shape with two first positioning elements 251 configured with a 180-degree included angle in between on the circumference. Each first positioning element 251 contains a notch 252 between two protrusions 253, all connected with continuous slopes.

Each knob socket 15 is of a circular shape with four second positioning elements 151 along the circumferential wall. Each pair of adjacent second positioning elements 151 has a 90-degree included angle in between. Each second positioning element 151 has a protrusion matching the notch 252 of a corresponding first positioning element 25. When the plug 20 is retracted or erected, the protrusion is embedded in the notch 252 of a corresponding first positioning element 25, thereby precisely and reliably locking the plug 20.

Figure 9:
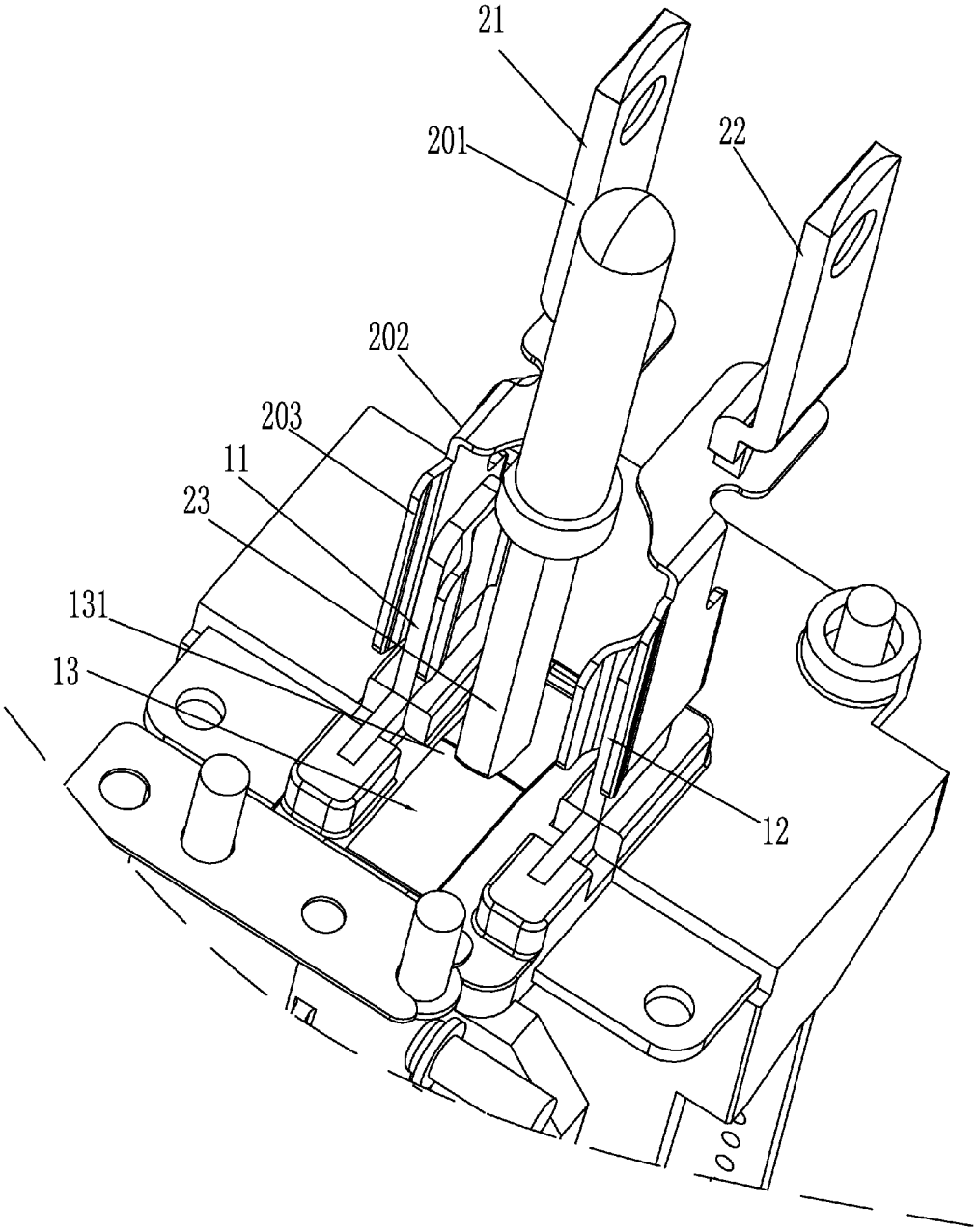
FIG. 9 is a perspective diagram showing pins of a plug of the power adaptor of FIG. 1 when the plug is erected.
Figure 10:
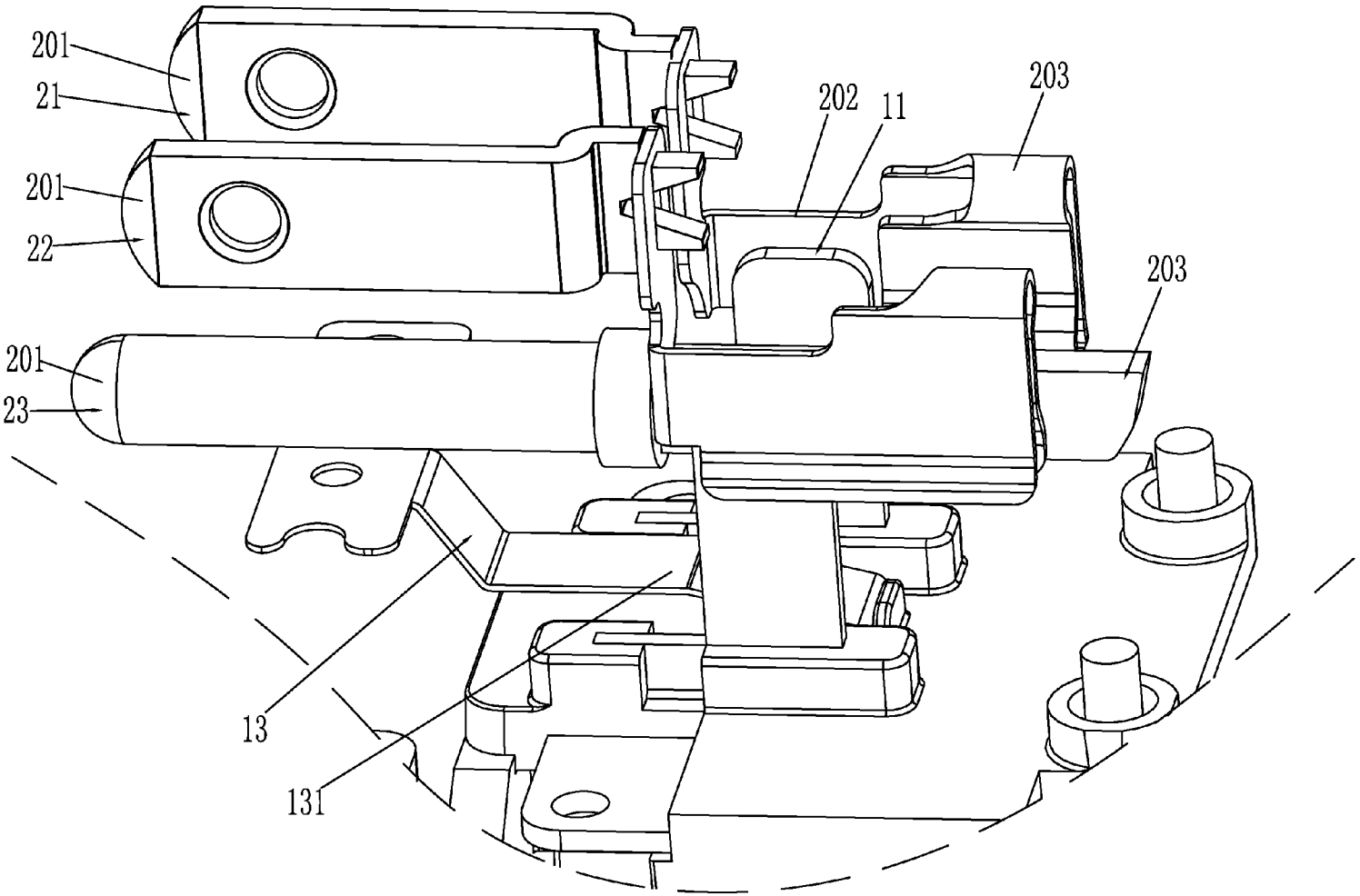
FIG. 10 is a perspective diagram showing pins of a plug of the power adaptor of FIG. 1 when the plug is retracted.
Figure 11:
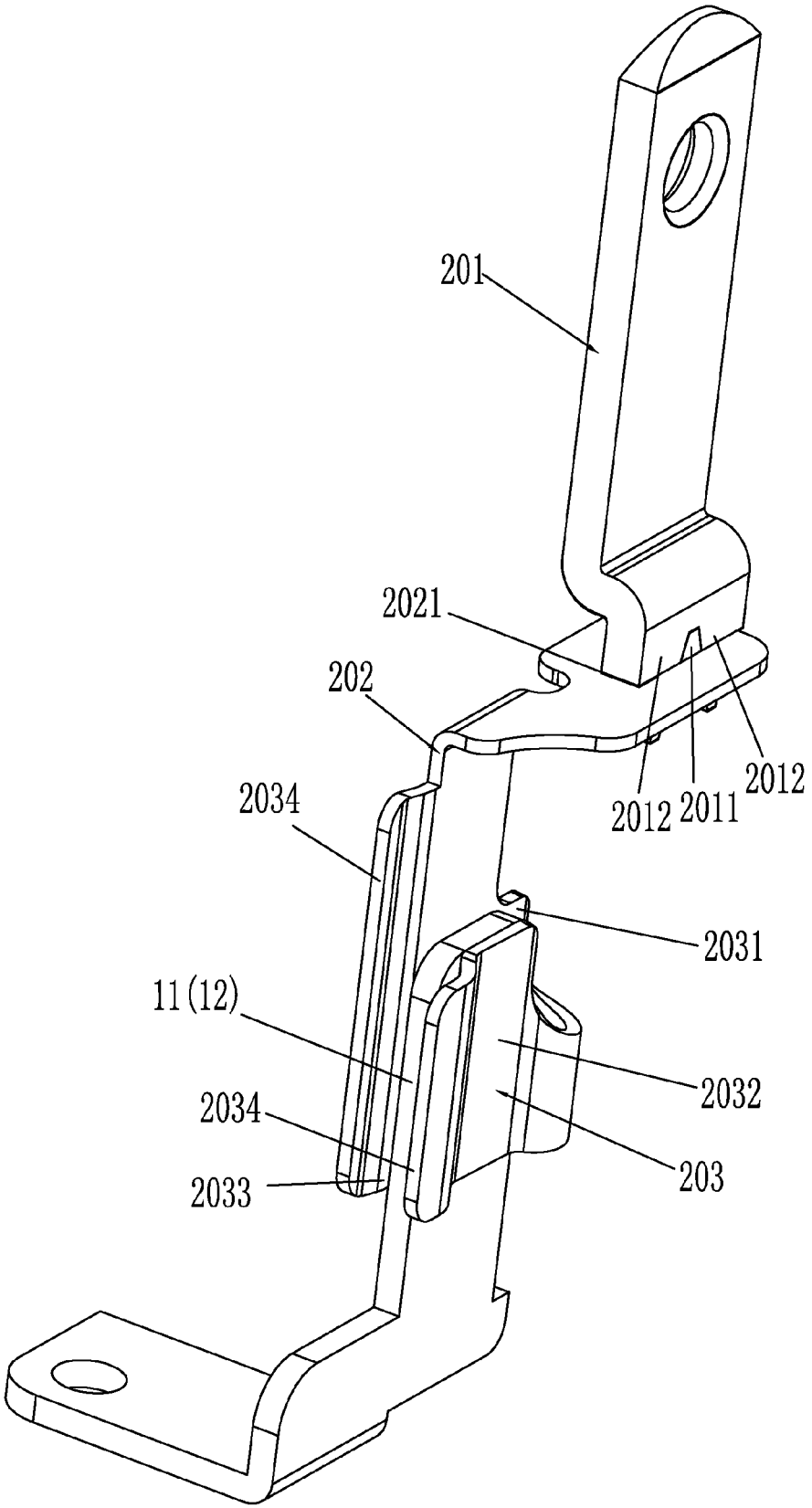
FIG. 11 is a perspective diagram showing a positive or negative pin of the power adaptor of FIG. 1.
Figure 12:
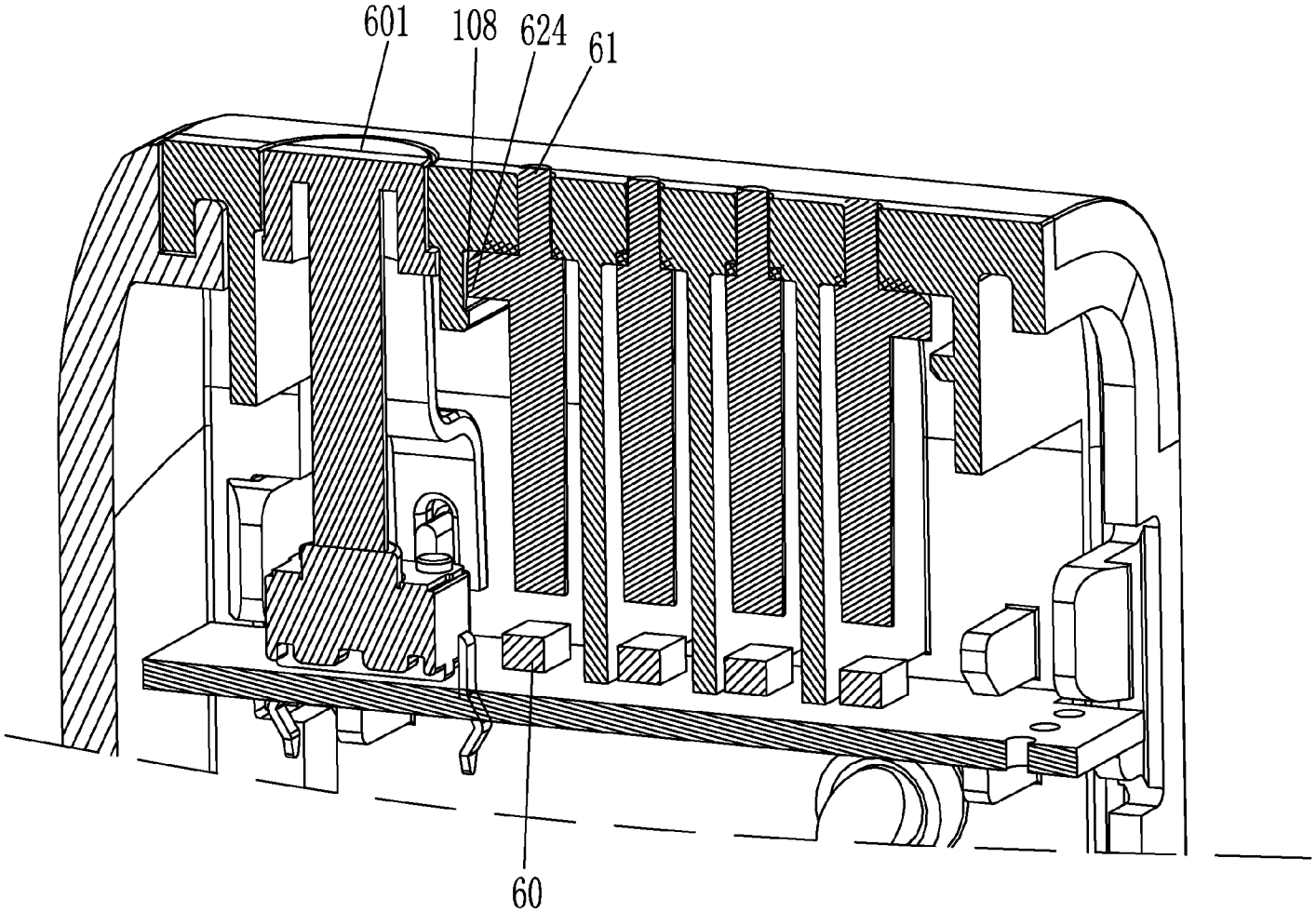
FIG. 12 is a partial sectional diagram showing the power adaptor of FIG. 1.
Figure 13:
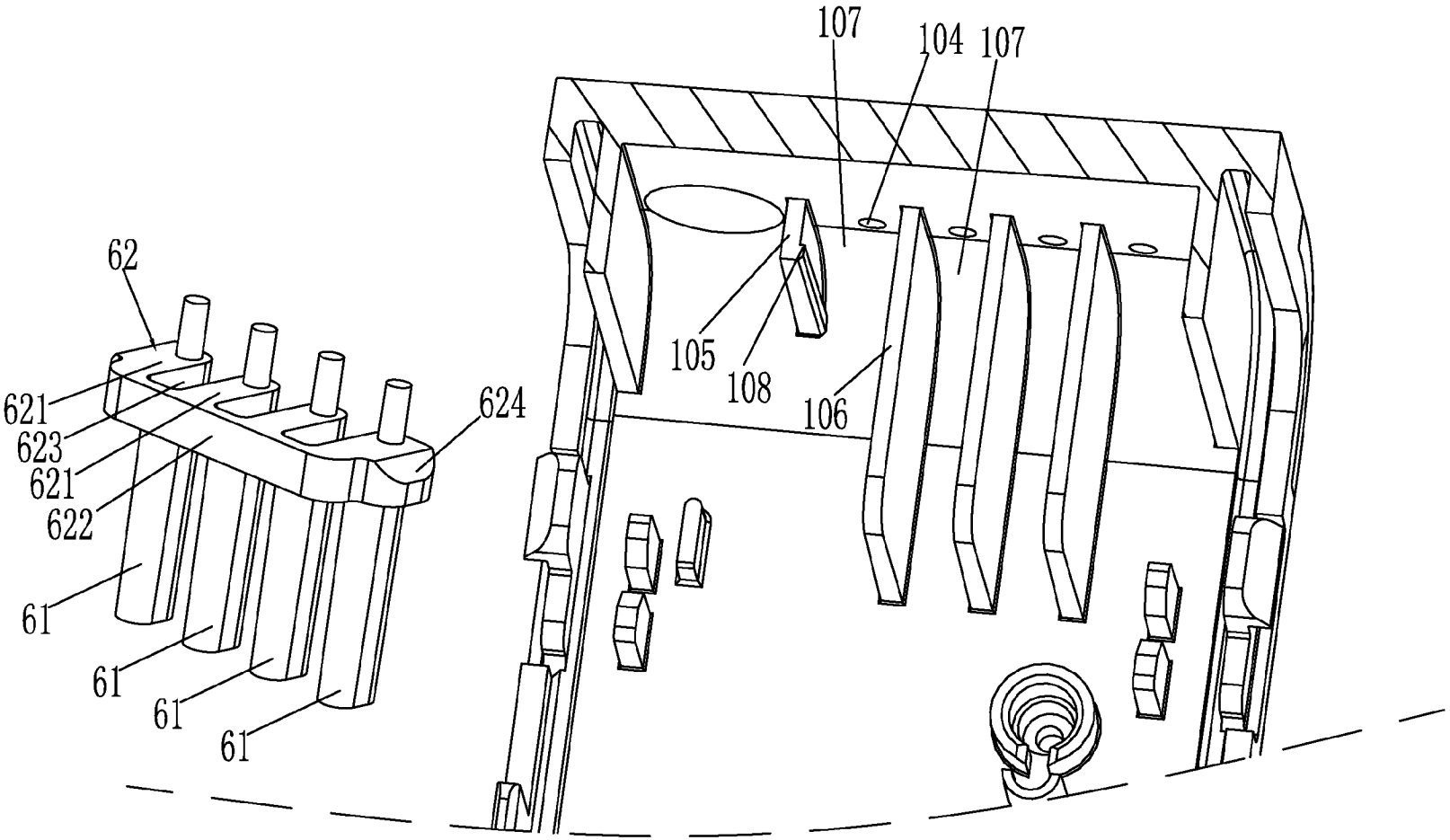
FIG. 13 is a perspective diagram showing a partial part inside the main member and a number of light bars arranged on a frame of the power adaptor of FIG. 1.

As shown in FIGS. 9 to 11, each of the positive and negative pins 21 and 22 has a bridge section 202 between the prong section 201 and the terminal section 203. Each bridge section 202 has a lateral slot 2021. A bottom end of each prong section 201 of the positive and negative pins 21 and 22 also a vertical slot 2011, thereby splitting the bottom end of each prong section 201 into two legs 2012 with flexibility. Both legs 2012 are plugged into the lateral slot 2021. Each terminal section 203 of the positive and negative pins 21 and 22 contains a first piece 2031 and a second piece 2032 arranged in parallel. The second piece 2032 is extended from a back edge of the first piece 2031 and then bended and further extended towards a front direction, thereby forming a flexible slot 2033 with a front slit. Each first and second pieces 2031 and 2032 is further extended from a front edge to the front direction into a guiding piece 2034 to facilitate the reception of the positive or negative connection plate 11 or 12. As to the ground pin 23, it has a cylindrical prong section 201 and a column-shaped terminal section 203.

The positive, negative, and ground connection plates 11, 12, and 13 are for contacting the positive, negative, and ground pins 21, 22, and 23, respectively. The positive and negative connection plates 11 and 12 are vertical flat pieces whereas the ground connection plate 13 is a lateral flexible piece with an upwardly bulging ridge section 131 in the middle.

When the plug 20 is erected from the main member 10, the positive and negative connection plates 11 and 12 are received in the slots 2033 via the front slits of the positive and negative pins 21 and 22. The terminal section 203 of the ground pin 23 has its bottom end contacting the ridge section 131 of the ground connection plate 13. When the plug 20 is turned and retracted into the indentation of the main member 10, the positive and negative connection plates 11 and 12 are released from the clamping of the first and second pieces 2031 and 2032 of the positive and negative pins 21 and 22. The bridge sections 202 of the positive and negative pins 21 and 22 are located at a distance besides the positive and negative connection plates 11 and 12. The bottom end of the terminal section 203 of the ground pin 23 also breaks the contact with the ridge section 131 of the ground connection plate 13.

As shown in FIG. 7, the indentation contains a first accommodation space 141 for receiving the plug body 24 and a second accommodation space 142 for receiving the prong sections 201. The second accommodation space 142 contains three sub-spaces 1421 for accommodating the prong sections 201 of the positive, negative, and ground pins 21, 22, and 23. The three sub-spaces 1421 are connected with each other and with the first accommodation space 141 as well.

Figure 6:
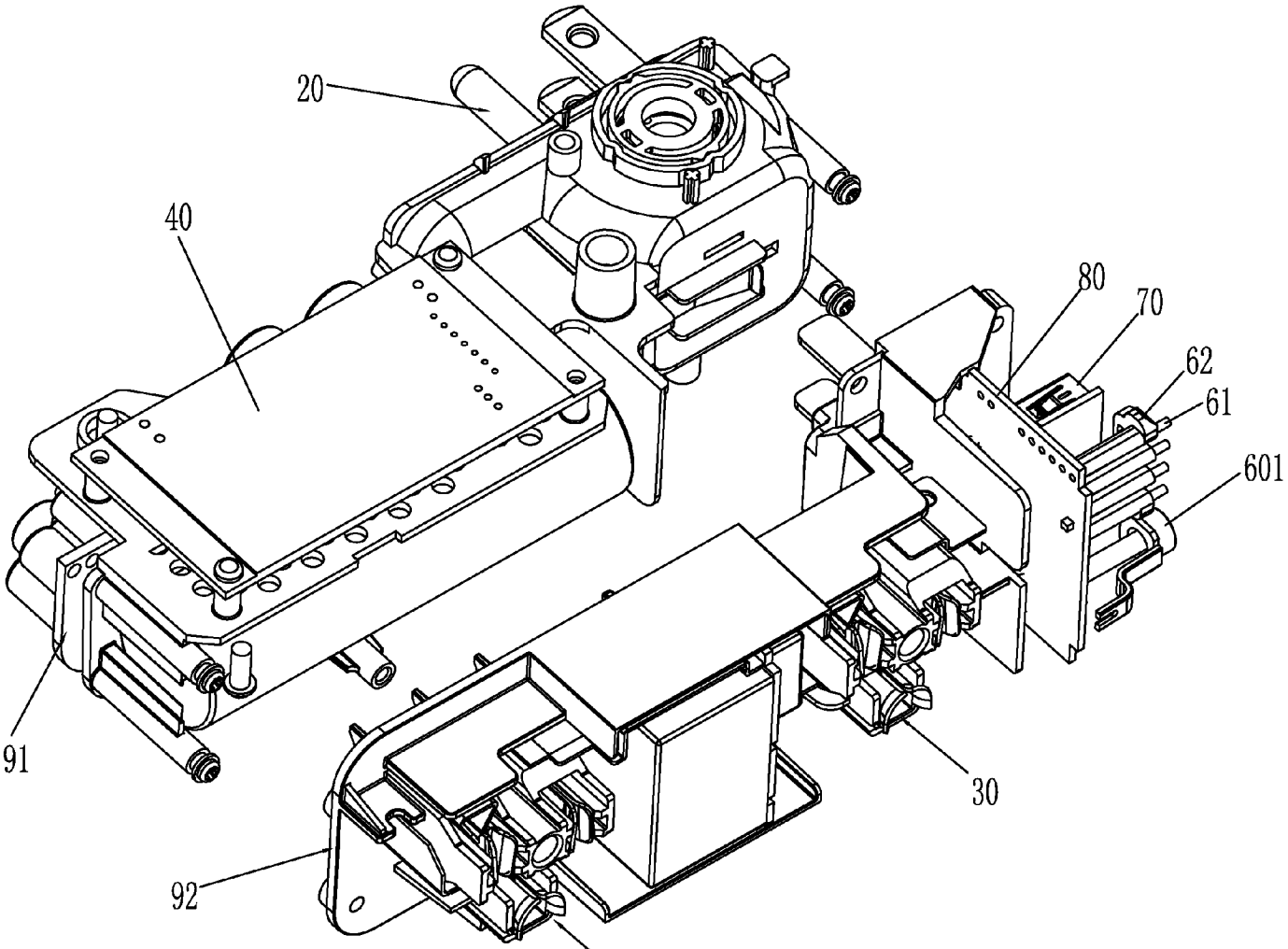
FIG. 6 is a perspective break-down diagram of the component of FIG. 5.
Figure 14:
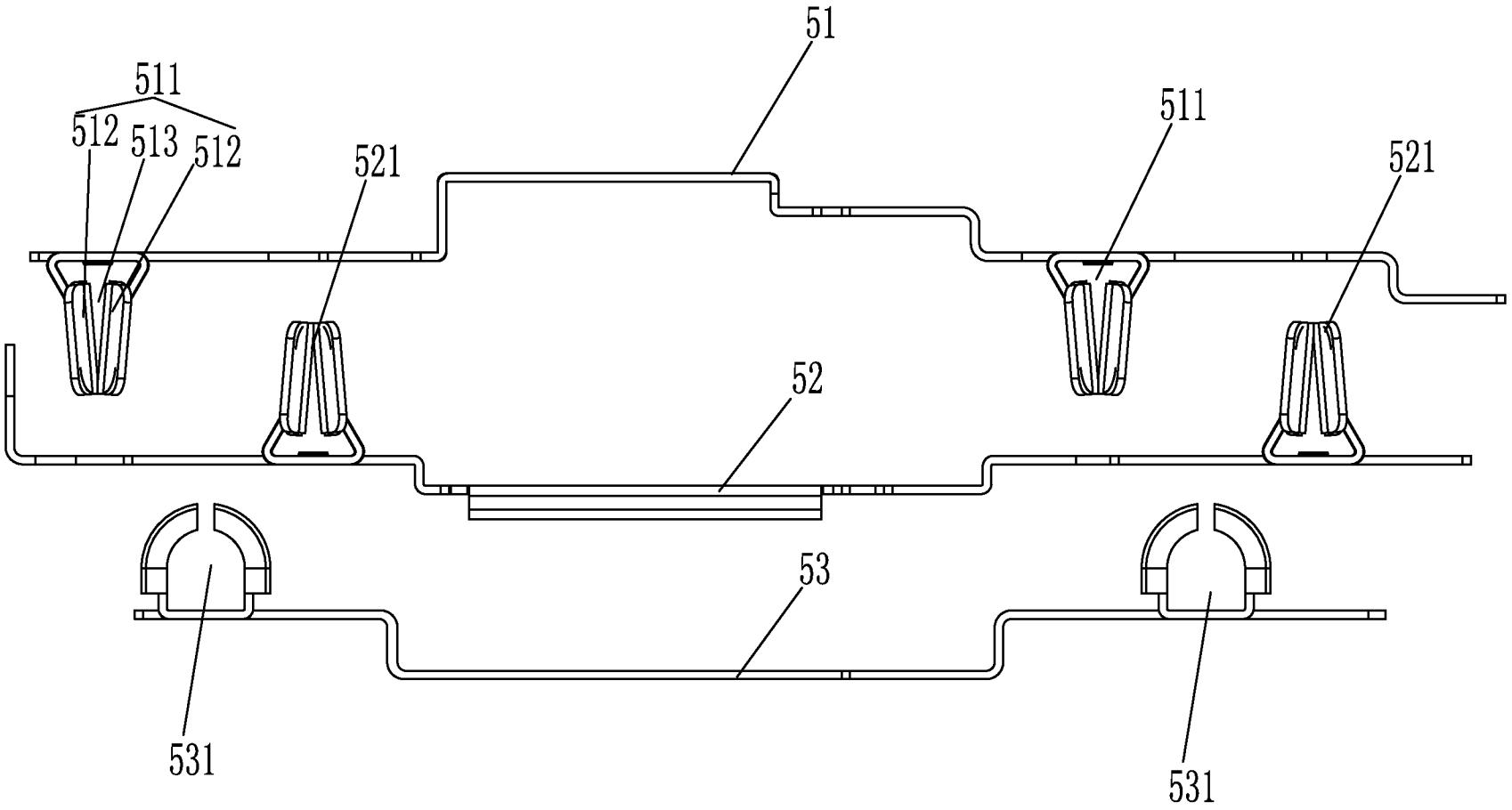
FIG. 14 is a schematic diagram showing positive, negative, and ground metallic plates of the power adaptor of FIG. 1.

As shown in FIGS. 5 and 6, a first circuit board 40 is housed inside the main member 10 and electrically connected between the connection plates 11, 12, 13 and the power sockets 30. There can be two or more power sockets 30. Each power socket 30 contains positive, negative, and ground sockets. The positive sockets of all power sockets 30 are connected in series. Similarly, the negative and ground sockets of all power sockets 30 are connected in series, respectively. One of the power sockets 30 has its positive, negative, and ground sockets connected to the first circuit board 40, respectively. In the present embodiment, as shown in FIG. 14, inside the main member 10, there are a positive metallic plate 51, a negative metallic plate 52, and a ground metallic plate 53 providing the series connections for all power sockets 30. The positive metallic plate 51 is integrally formed with a number of positive terminals 511. Similarly, the negative and ground metallic plates 52 and 53 are integrally formed with a number of negative and ground terminals 521 and 531, respectively. Each terminal 511, 521, or 531 contains two flexible pieces (e.g., 512) with a flexible receiving hole (e.g., 513) in between.

Figure 4:
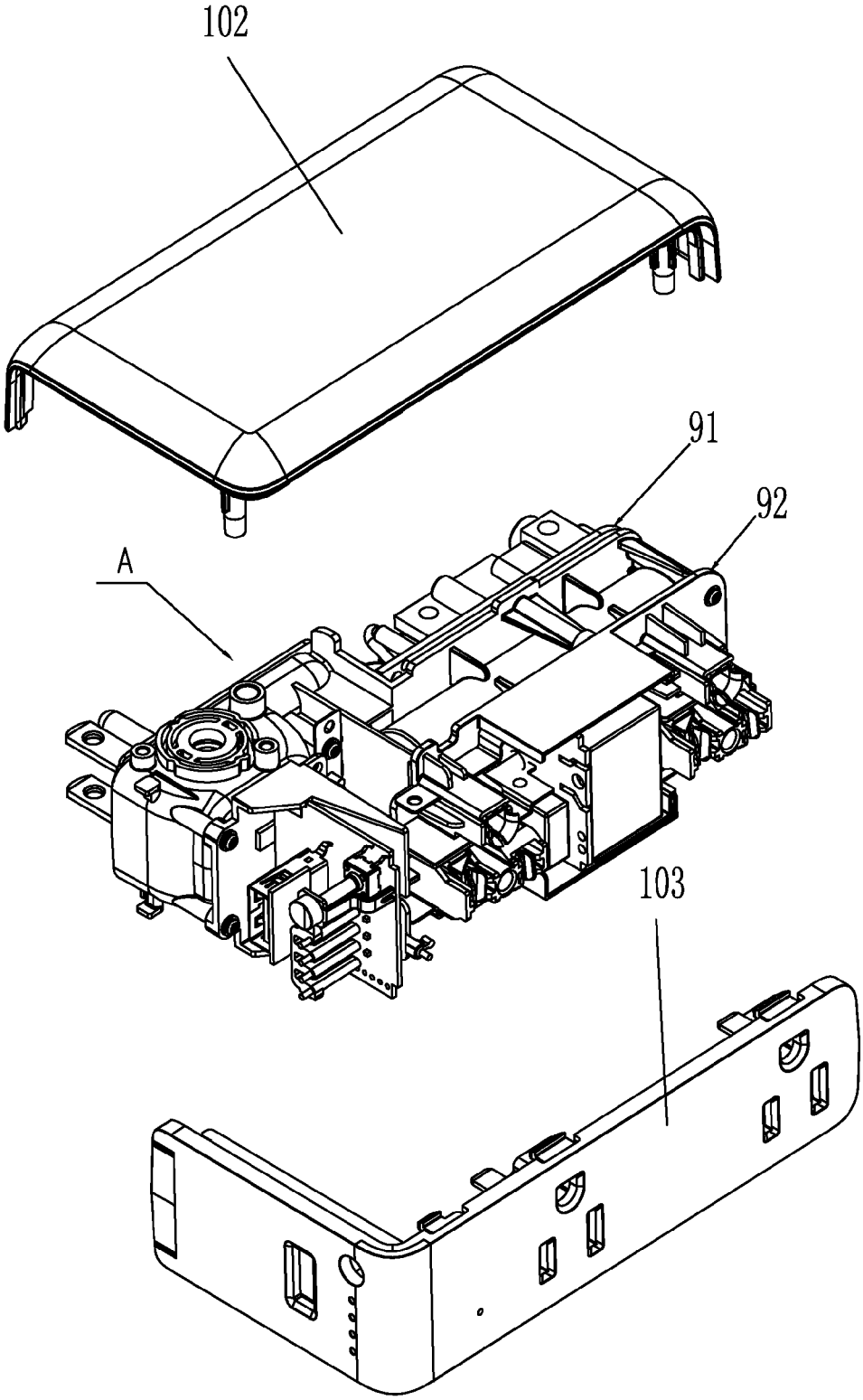
FIG. 4 is a perspective break-down diagram showing the power adaptor of FIG. 1 without a bottom casing.

As shown in FIGS. 1, 2, 12, and 13, the main member 10 contains a top casing 101 and a bottom casing (not numbered) joined together. The top casing 101 can be further divided into a first top casing 102 and a second top casing 103, as shown in FIG. 4. A number of light emitting diodes (LEDs) 60 are housed inside the main member 10, the casings also have corresponding holes 104 for the light emitted from the LEDs 60. There is also a button 601 on the casings for controlling the LEDs 60. To facilitate the light transmission from the LEDs 60 to the holes 104, light bars 61 are configured in between.

More specifically, the light bars 61 are arranged by a frame 62. The frame 62 contains a number of arms 621 in parallel on a frame body 622 with first gaps 623 formed between neighboring arms 621. Each arm 621 has a through channel at a front end and each through hole is threaded through by a front end of a light bar 61. A back end of the light bar 61 is positioned in front of a LED 60. Each of the frame body 622's lateral edge has a first flange 624.

Along a wall where the holes 104 are configured, two arm pieces 105 are configured with the holes 104 in between. A number of separation pieces 106 are arranged in parallel between the arm pieces 105 so that each separation piece 106 is located between two neighboring holes 104. Therefore a number of second gaps 107 are formed between the separation pieces 106 and the arm pieces 105. During assembly, the light bars 61 are configured on the frame body 622, and the frame body 622 is then locked by the arm pieces 105 with the arms 621 received by the second gaps 107 and the separation pieces 106 received by the first gaps 623, respectively. Each limiting arm 105 has a second flange 108 facing the separation pieces 106 to engage a corresponding first flange 624 so as to reliably position the frame body 622.

As shown in FIGS. 1, 2, 3, and 5, there can be at least a universal serial bus (USB) socket 70 configured on the casings. A second circuit board 80 is housed inside the main member 10 electrically connected to the USB socket 70 and the LEDs 60, and with the connection plates 11, 12, and 13 as well. With two circuit boards 40 and 80 providing interconnection, the layout of the various components of the power adaptor can be conveniently arranged. To further facilitate the arrangement of the various components, two inner frames 90 are configured inside the main member 10. The present invention as such makes the most use of the space inside the main member 10, effectively reducing the dimension of the power adaptor.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A power adaptor comprising:

a main member having an indentation along a circumferential side of the main member where a plurality of connection plates are configured on a bottom side of the indentation; two knob sockets are configured on two opposing side walls of the indentation; each knob socket has at least a second positioning element along the knob socket's circumferential side wall;

a retractable plug configured in the indentation where the plug comprises an insulating plug body, two knob member, and a plurality of pins for electrically connecting the connection plates, respectively, each pin comprises a prong section exposed outside the plug body and a terminal section inside the plug body, a circular knob member is configured on each of two opposing circumferential sides of the plug body, and each knob member is received by a corresponding knob socket and configured with at least a first positioning element on the knob member's circumference for engaging a corresponding second positioning element; and at least a power socket on the main member;

wherein the plug is capable of being turned and retracted into the indentation with the pins' terminal sections away from the connection plates of the main member; and the plug is capable of being turned and erected from the indentation with the pins' terminal sections contacting the connection plates of the main member.

2. The power adaptor according to claim 1, wherein the pins comprises a positive pin, a negative pin, and a ground pin; each of the positive and negative pin further comprises a bridge section between the prong and terminal sections; each terminal section comprises a first piece and a second piece arranged in parallel; the second piece is extended from a back edge of the first piece and then bended and further extended towards a front direction, thereby forming a flexible slot with a front slit; the connection plates comprises a positive connection plate, a negative connection plate, and a ground plate for contacting the positive, negative, and ground pins, respectively; the positive and negative connection plates are vertical flat pieces; when the plug is turned and erected from the main member, the positive and negative connection plates are plugged into the corresponding flexible slots via corresponding front slits, respectively; and, when the plug is turned and retracted into the main member, the positive and negative connection plates are separated from the flexible slots with the bridge sections staying a distance besides the positive and negative connection plates.

3. The power adaptor according to claim 2, wherein each of the first and second pieces is further extended from a front edge to the front direction into a guiding piece to facilitate the reception of a positive or negative connection plate.

4. The power adaptor according to claim 2, wherein each bridge section has a lateral slot; a bottom end of each prong section of the positive and negative pins comprises a vertical slot, splitting the bottom end of the prong section into two legs with flexibility; and both legs are plugged into the lateral slot of a corresponding bridge section.

5. The power adaptor according to claim 2, wherein the ground pin is vertically erected with a cylindrical prong section and a column-shaped terminal section; the ground connection plate is a lateral flexible piece with an upwardly bulging ridge section in the middle; and the terminal section of the ground pin contacts or stays away from the ridge section as the plug is erected or retracted from the main member.

6. The power adaptor according to claim 2, wherein the indentation comprises a first accommodation space for receiving the plug body and a second accommodation space; the second accommodation space comprises three sub-spaces for accommodating the prong sections of the positive, negative, and ground pins; and the three sub-spaces are connected with each other and with the first accommodation space as well.

7. The power adaptor according to claim 2, wherein a first circuit board is housed inside the main member and electrically connected between the connection plates and the power sockets; there are two or more power sockets; each power socket comprises positive, negative, and ground sockets; the positive, negative, and ground sockets of all power sockets are connected in separate series connections, respectively; and one of the power sockets has its positive, negative, and ground sockets connected to the first circuit board.

8. The power adaptor according to claim 7, wherein there are a positive metallic plate, a negative metallic plate, and a ground metallic plate providing the series connections for all power sockets; the positive, negative, and ground metallic plates are integrally formed with a plurality of positive, negative, and ground terminals, respectively; and each terminal comprises two flexible pieces with a flexible receiving hole in between.

9. The power adaptor according to claim 7, wherein the main member comprises a casing; a plurality of light emitting diodes (LEDs) are housed inside the casing; the casing has corresponding holes for the light emitted from the LEDs; a plurality of light bars are configured inside the casing, each between a LED and a corresponding hole; the light bars are arranged by a frame; the frame comprises a frame body and a plurality of arms in parallel on the frame body with first gaps formed between neighboring arms; each arm has a through channel at a front end; each through hole is threaded through by a front end of a light bar; a back end of the light bar is positioned in front of a LED; each of the frame body's lateral edge has a first flange; along a wall where the holes are configured, two arm pieces are configured with the holes in between; a plurality of separation pieces are arranged in parallel between the arm pieces so that each separation piece is located between two neighboring holes, forming a plurality of second gaps between the separation pieces and the arm pieces; during assembly, the frame body is then locked by the arm pieces with the arms received by the second gaps and the separation pieces received by the first gaps, respectively; each limiting arm has a second flange facing the separation pieces to engage a corresponding first flange; and there is a button on the casing for controlling the LEDs.

10. The power adaptor according to claim 9, wherein there is at least a universal serial bus (USB) socket configured on the casing; a second circuit board is housed inside the casing electrically connected to the USB socket, the LEDs, and the connection plates.

* * * * *